US011377269B2

(12) United States Patent
van Driel et al.

(10) Patent No.: US 11,377,269 B2
(45) Date of Patent: Jul. 5, 2022

(54) CLOSURE UNIT FOR A CONTAINER, COMBINATION OF SUCH A CLOSURE UNIT AND A CONTAINER AND METHOD FOR CLOSING A CONTAINER

(71) Applicant: Curtec Nederland B.V., Rijen (NL)

(72) Inventors: Ilse Wilhelmina Hendrika van Driel, Schijndel (NL); Sigebertus Johannes Jacobus Jozef Meggelaars, Eindhoven (NL); Robertus Franciscus Cornelia Maria Aarts, Tilburg (NL)

(73) Assignee: Curtec Nederland B.V., Rijen (NL)

( * ) Notice: Subject to any disclaimer, the term of this patent is extended or adjusted under 35 U.S.C. 154(b) by 21 days.

(21) Appl. No.: 16/361,912

(22) Filed: Mar. 22, 2019

(65) Prior Publication Data

US 2019/0291928 A1 Sep. 26, 2019

(30) Foreign Application Priority Data

Mar. 23, 2018 (NL) ..... 2020656

(51) Int. Cl.

| | |
|---|---|
| ***B65D 43/16*** | (2006.01) |
| ***B65D 21/02*** | (2006.01) |
| ***B65D 51/18*** | (2006.01) |
| ***B65D 45/32*** | (2006.01) |
| ***B65D 43/02*** | (2006.01) |

(52) U.S. Cl.

CPC ..... *B65D 43/161* (2013.01); *B65D 21/022* (2013.01); *B65D 21/0233* (2013.01); *B65D 43/0202* (2013.01); *B65D 45/32* (2013.01); *B65D 51/18* (2013.01); *B65D 2251/0021* (2013.01); *B65D 2251/0081* (2013.01); *B65D 2543/00027* (2013.01); *B65D 2543/00092* (2013.01); *B65D 2543/00194* (2013.01); *B65D 2543/00231* (2013.01);

(Continued)

(58) Field of Classification Search

CPC ..... B65D 43/161; B65D 51/18; B65D 45/32; B65D 43/0202; B65D 21/022; B65D 21/0233; B65D 2251/0081; B65D 2251/0021; B65D 2543/00379; B65D 2543/00027; B65D 2543/00194; B65D 2543/00231; B65D 2543/00972; B65D 45/24

See application file for complete search history.

(56) References Cited

U.S. PATENT DOCUMENTS 988,116 A * 3/1911 Lee et al. ..... B65D 47/286 215/322
1,324,256 A * 12/1919 Langan ..... B65D 45/24 215/293

(Continued)

FOREIGN PATENT DOCUMENTS

EP 0072604 A1 2/1983
WO WO-9616876 A1 * 6/1996 ..... B65D 45/02

*Primary Examiner* — James N Smalley
(74) *Attorney, Agent, or Firm* — The Webb Law Firm

(57) ABSTRACT

Closure unit for a container, comprising a substantially flat cover element, for closing off the aperture in the container which cover element is provided with a tension element, for creating a pressure force that presses the cover element to a rim that surrounds the aperture of the container. The invention also prides a closure unit and a container as well as to methods for closing and opening a container with such a closure unit.

13 Claims, 8 Drawing Sheets

(52) U.S. Cl.
CPC ..... *B65D 2543/00296* (2013.01); *B65D 2543/00379* (2013.01); *B65D 2543/00972* (2013.01)

(56) References Cited

U.S. PATENT DOCUMENTS

| | | | | | |
|---|---|---|---|---|---|
| 1,951,559 | A * | 3/1934 | Pyott | B65D 45/24 | 215/316 |
| 1,962,626 | A | 6/1934 | Townsend | | |
| 2,279,991 | A * | 4/1942 | Hotchkiss | B65D 45/02 | 215/280 |
| 2,380,443 | A * | 7/1945 | Ingie | B65D 45/28 | 215/290 |
| 3,049,224 | A | 8/1962 | Fredette et al. | | |
| 3,422,997 | A * | 1/1969 | Anderson | B65D 47/26 | 222/542 |
| 3,893,566 | A | 7/1975 | Ross | | |
| 3,904,074 | A | 9/1975 | Hoffman et al. | | |
| 3,934,518 | A * | 1/1976 | Adler | B65D 90/10 | 105/377.11 |
| 4,175,668 | A * | 11/1979 | Hebert | B65D 45/04 | 215/354 |
| 4,358,025 | A | 11/1982 | Urion | | |
| 4,387,825 | A | 6/1983 | Parent | | |
| 4,442,735 | A * | 4/1984 | Chance | B67B 7/066 | 215/272 |
| 4,801,033 | A * | 1/1989 | Kanner | B65D 39/0023 | 215/322 |
| 5,555,995 | A * | 9/1996 | Galer | B65D 43/12 | 220/315 |
| 10,150,596 | B2 * | 12/2018 | Di Giuseppantonio | B65D 45/06 | |
| 2007/0235460 | A1 * | 10/2007 | Killinger | B65D 43/0222 | 220/675 |
| 2010/0140270 | A1 * | 6/2010 | Becklin | B65D 45/32 | 220/315 |
| 2014/0360971 | A1 * | 12/2014 | Marino | B65D 79/005 | 215/260 |
| 2015/0014320 | A1 * | 1/2015 | Koo | B65D 43/12 | 220/324 |
| 2017/0190480 | A1 * | 7/2017 | Liberati | B65D 45/24 | |

* cited by examiner

CLOSURE UNIT FOR A CONTAINER, COMBINATION OF SUCH A CLOSURE UNIT AND A CONTAINER AND METHOD FOR CLOSING A CONTAINER

CROSS-REFERENCE TO RELATED APPLICATION

This application claims priority to Dutch Patent Application No. 2020656 filed Mar. 23, 2018, the disclosure of which is hereby incorporated by reference in its entirety.

BACKGROUND OF THE INVENTION

Field of the Invention

The present invention relates to a closure unit for a container. The invention also relates to such a closure unit and a container as well as to methods for closing and opening a container with such a closure unit.

Description of Related Art

Removable and attachable closures for various types of open topped containers like buckets, bins, jars, tanks are well known. Well known covers, lids and other covers are fastened, attached, mounted or secured to the open topped container by a cover that may grip the container or that may be attached with a screw connection. Furthermore there are also alternatives for coupling a closure to an open topped container using a strap type of fastener enclosing a rim of the closure to clamp it against a flange surrounding the opening in the open topped container.

The object of the present invention is to provide a closure for an open topped container that is easy to attach and to release from the container (thus is user-friendly) while providing a high quality sealing of the closure onto the container.

SUMMARY OF THE INVENTION

To realise this objective the present invention provides a closure unit for a container, comprising a substantially flat cover element for closing off the aperture in the container, which cover element is provided with a tension element, for creating a pressure force that presses the cover element to a rim that surrounds the aperture of the container in the situation wherein the closure unit is applied onto the container for closing off the aperture; which tension element is provided with couplings for cooperation with the container in order to create the pressure force, wherein the tension element in a closed position is enclosing at least the perimeter of the substantially flat cover element and is pressing the substantially flat cover element at at least one contact surface while the couplings of the tension element are in cooperating contact with the container; wherein the tension element is composed of at least two mutually displaceable parts, the mutually displaceable parts being moveable between an open position and the closed position, which positions achieve an open configuration resp. closed configuration of the tension element, wherein the closed position of the mutually displaceable parts, in the situation wherein the couplings of the tension element are in cooperating contact with the container, results in at least one contact surface of the tension element being pressed in a direction having at least a component of the movement perpendicular to the flat cover element.

The closure unit according to the invention is to be placed on the aperture in the container so that the opening in the container is completely covered and closed off by the cover element. A typical container to be closed with the closure unit according the present invention is typically an open topped holder, like for instance a bin, bucket, pot, can, bucket, cup or beaker. More specific the container is a plastic packaging, use for packing product like pharmaceuticals, specialty chemicals, fine chemicals, food ingredients.

The present invention provides a closure unit enabling a high quality closure for packing these types of product combined with easy opening and closure. When the opening in the container is closed off by the cover element, the tension element provides a solid coupling of the cover element onto the container by virtue of couplings that cooperate with the container which at the same time create a pressure force pressing the tension element against the cover element. This pressure force results in the cover element being pressed against the container, and effectively enhances the sealing of the flat cover element onto the container. The functional name "tension element" is thus not only limited to the function of exerting a pressure onto the cover element but also incorporates the functionality of securing the closure unit onto a container.

Furthermore the at least two mutually displaceable parts of the tension element make the closure unit easy to use, amongst others due to the fact that the mutual orientation of the displaceable parts may be controlled by the construction of the tension element.

Normally the container will be provided with a rim like a raised edge or flange, on the outside provided with a profile to cooperate with the couplings of the tension element. The perimeter of the substantially flat cover is the outline/contour of the cover and as the tension element is surrounding the flat cover in a closed position the location of the cover relative to (the aperture in) the container is fully controlled; the chance of an incorrect closure is thus limited. The present closure unit is thus fool-proof in use.

With such a coupling a vacuum gas- and/or fluid-tight closure unit may be provided of even such a high quality that also pressure difference between container interior and exterior may be maintained after closure. Such a high quality closure unit (or high quality tightness) may for instance also be useful to keep the container interior free of moisture that may be essential to preserve certain products. A high quality of the closure unit also enables the safe storage and transportation of hazardous goods as well as the hygiene management of products that are susceptible to contamination. The present closure unit is also sustainable as the closure unit is re-useable; dependent on the specific circumstances of the use of the closure unit it may or may not have to be cleaned before re-use.

In an embodiment of the closure unit according the present invention the movement of the mutual displaceable parts of the tension element towards the closed position results in a movement of at least one contact surface of the tension element being displaced in a direction towards the flat cover element. Such relative movement may be the result of the at least two mutual displaceable parts of the tension element being for instance rotatably connected, e.g. such that the rotatable parts in the closed position are lying in a single plane. However as an alternative the at least two mutual displaceable parts of the tension element may also be translationally (slideable) connected. In case of translationally connected mutual displaceable parts the parts are lying in the open and in the closed position in a single (flat) plane. Rotatable mutual displaceable parts may have the advantage that one of the parts may be used as a lever, especially for generating the required closing force. Slideable mutual displaceable part may have the advantage that it requires less space to operate the closure.

In the closure unit according to the invention, it is preferred that the tension element is detachably connected to the cover element. As such, the closure unit allows to separate the tension element and the cover element from each other, when the closure unit is not used, for instance during cleaning of the closure unit. Further, such a construction allows easy replacement of one part when it is damaged, without the need to replace the whole tension element.

To secure the at least two mutual displaceable parts in their closed position the mutual displaceable parts may be provided with cooperating locking means. Such locking means may for instance be embodied as a protruding element on one of the displaceable parts that fits in an aperture of another of the mutual displaceable parts. For releasing such locking means it my for instance be possible to unlock the locking means by pressing the protruding element out of the aperture. In such construction the protruding part may be embodied as a deformable "push button". The advantage of providing locking means that the chance of uncontrolled opening of the closure unit is substantially limited.

For a solid fit between the cover element and the container the cover element may be provided with a groove for at least partially receiving the aperture surrounding rim of the container. Another technical feature to enhance the fitting of the cover element and the container may be to provide the cover element with a gasket for contacting the aperture surrounding rim of the container. Such gasket may be made out of a flexible material like for instance rubber. The groove and/or the gasket may enhance the quality of the closure, for instance to realise a water vapour and/or gas tight closure. In case both the groove and the gasket are provided, the gasket may fit the groove in the cover element to minimise/limit the number of separate closure unit parts.

A suited material for producing the cover element and/or the tension element is polymeric material (plastic), like for instance polyethylene (HDPE) or polypropylene. These materials not only qualify to efficiently produce the closure unit but these materials also qualify for packaging sensitive products like food products and medicine.

The side of the closure unit facing away from the container may be provided with a recess for receiving a container bottom. The recess helps to enable stable stacking of plural closed containers on top of each other. And in case the side of the closure unit facing away from the container fits the side of an identical closure unit facing towards the container also the closure assemblies are stackable (or even nestable), So the fitting of the separate closure assemblies may be solidly stacked also. Furthermore also the (open) containers may be nestable, providing plural variations in stacking and/or nesting of containers and closure assemblies in open and/or closed conditions.

Normally the closure unit will have a substantially rectangular or circular shape and additional to one or more of the optional features as disclosed above the closure unit may also be embodied as tamper evident.

The present invention also provides a combination of the closure unit according the invention and a container, which container is provided with at least one aperture surrounded by an aperture rim and wherein the closure unit fits the aperture rim. Applicable designs of the container may be substantially 3d rectangular box-shaped including a substantially rectangular open top, or, as an alternative, substantially drum-shaped including a substantially circular open top.

To provide solid coupling the closure unit may be provided with cooperating counter-couplings that cooperate with the couplings of the closure unit in such a way that in the closed configuration of the tension element an interlocking of the couplings and counter-couplings is achieved which creates a pressure force that presses the cover element onto the container. These cooperating couplings and counter-couplings thus transfer the forces required to clamp the cover element onto the aperture surrounding rim in the container.

The present invention further relates to a method for closing a container with a closure unit according to the invention, comprising the method steps of:

A) providing an open topped container;

B) placing the closure unit on the container with the tension element in an open configuration, so that the cover element contacts the aperture surrounding rim the container and the couplings of the closure unit are aligned with counter couplings on the container for mutual interlocking;

C) moving the mutually displaceable parts of the tension element of the closure unit from the open position to the closed position whereby an interlocking of the couplings and counter-couplings is accomplished such that a pressure force is exerted by the tension element onto the cover element in the direction towards the container.

Conversely, the present invention relates to a method for opening a container closed off by a closure unit, wherein the container is closed off by a pressure force that is exerted by the tension element onto the cover element in the direction towards the container by virtue of the mutual interlocking of couplings and counter-couplings, comprising the method steps of:

X) moving the mutually displaceable parts of the tension element of the closure unit from the closed position to the opened position whereby the mutual interlocking of the couplings and counter-couplings is unlocked; and Y) removing the closure unit from the container such that the aperture of the container is rendered free.

For the advantages of these methods reference is made to the advantages already mentioned in relation to the closure unit according the invention. The closure unit is easy to close and to open without the requirement of any additional tools. The methods of opening and closing also require relative limited force in relation to the closure pressure that may be obtained as the closure unit may be used as a "lever" during closure and opening.

BRIEF DESCRIPTION OF THE DRAWINGS

The present invention will be further elucidated on the basis of the non-limitative exemplary embodiments shown in the following figures. Herein shows.

DESCRIPTION OF THE INVENTION

Figure 1A:
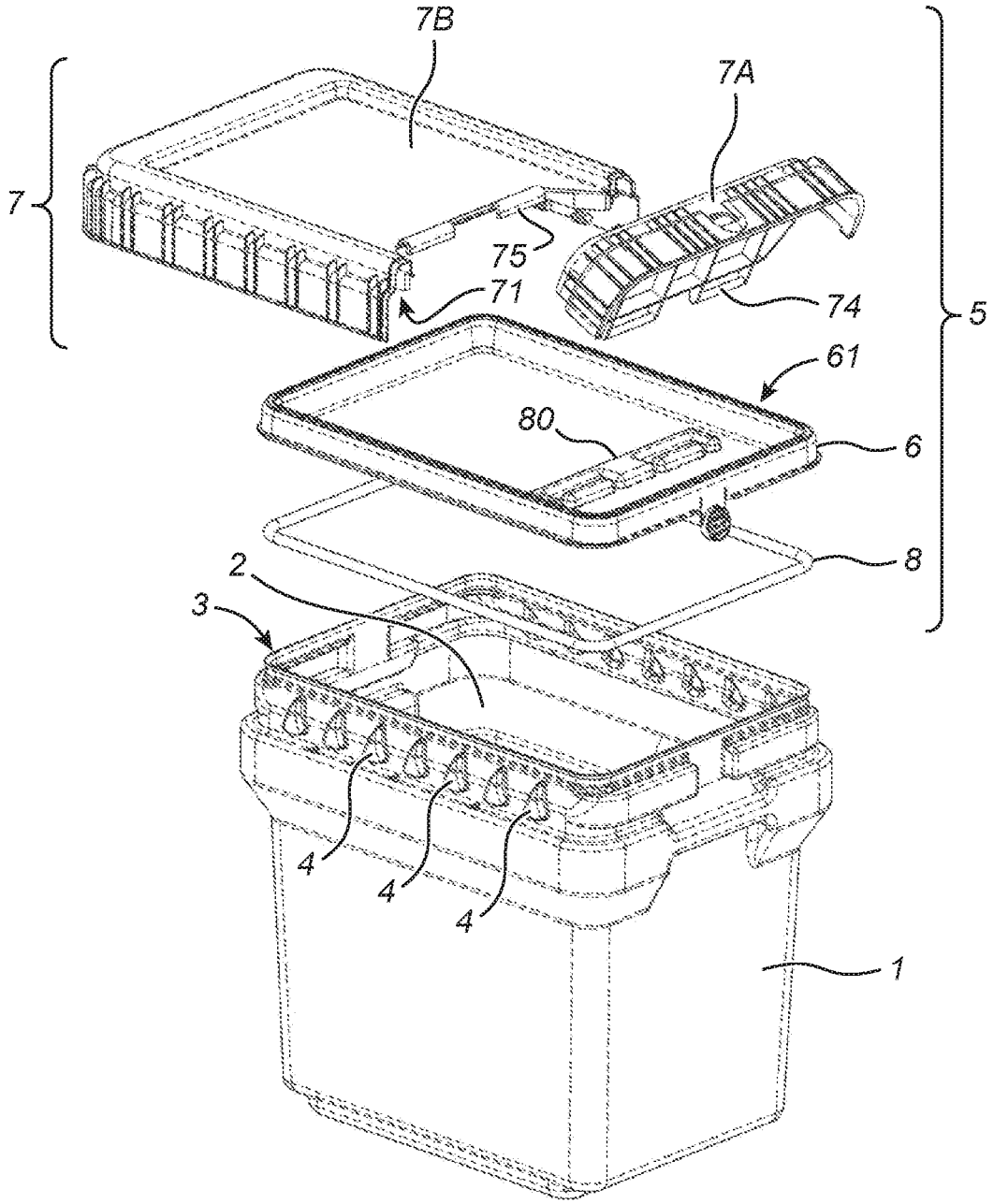
FIG. 1A an exploded view on a combination of a container and closure unit according the invention.

FIG. 1A shows a container 1 with an aperture 2 in the top. The aperture 2 in the container 1 is surrounded by a rim 3, around which rim 3 counter-couplings 4 are provided. Above the container 1, in an exploded view, a closure unit 5 is depicted. The closure unit 5 comprises a substantially flat cover element 6 that fits the rim 3 of the aperture 2 in the container 1. In the substantially flat cover element 6 a groove (that is not visible in this figure) is provided having dimensions so that it may partially receive the rim 3 of the aperture 2 in the container 1, in this groove also a gasket 8 may be housed, which gasket 8 may be made out of a flexible material. The closure unit 5 further comprises a tension element 7 that is composed of two mutual displaceable tension element parts 7A, 7B. These two mutually displaceable tension element parts 7A, 7B are rotatably connected and their operation will be further disclosed in relation to FIGS. 2A-2C.

The underside of the tension element part 7B has a profiling 71 which can be snapped onto the raised profile 61 that surrounds the cover element 6. As such, the tension element is detachably connected to the cover element, thus forming a closure unit. Part 7A and 7B are rotatably connected by virtue of hinging parts 74 resp. 75 which together form a hinging connection. On the upper side of the cover plate, an abutment structure 80 is provided against which the hinging part 74 abuts in order for the hinging connection to additionally function as a lever.

The profiling 71 of the tension element is such that it allows for a minor sliding movement of the tension element over the cover plate in the plane of the cover plate when snapped onto the raised profile 61.

Figure 1B:
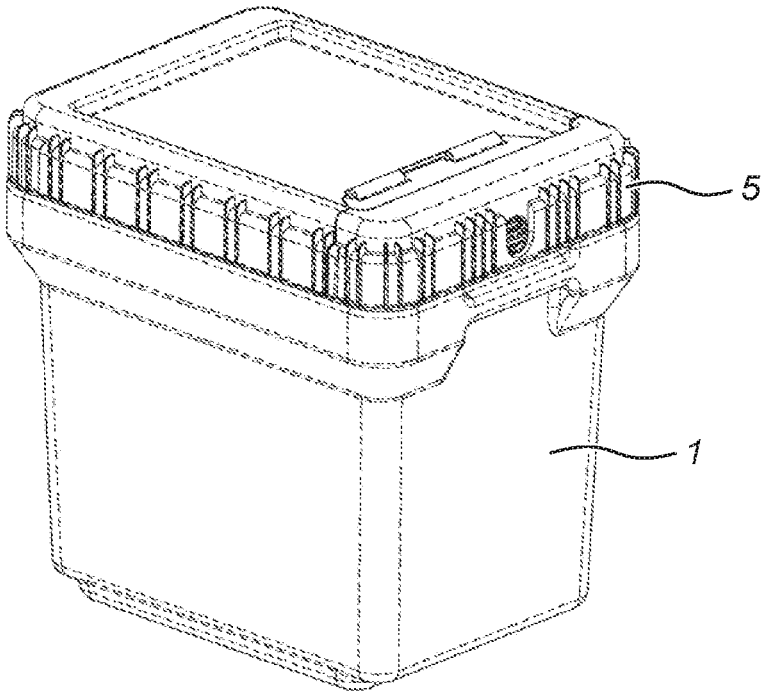
FIG. 1B a perspective view on the combination of the container and closure unit according FIG. 1A in an assembled and closed configuration.

FIG. 1B shows the combination of the container 1 and closure unit 5 according FIG. 1A in an assembled state. The closure unit 5 herein closes off the aperture 2 in the top of the container 1.

Figure 2A:
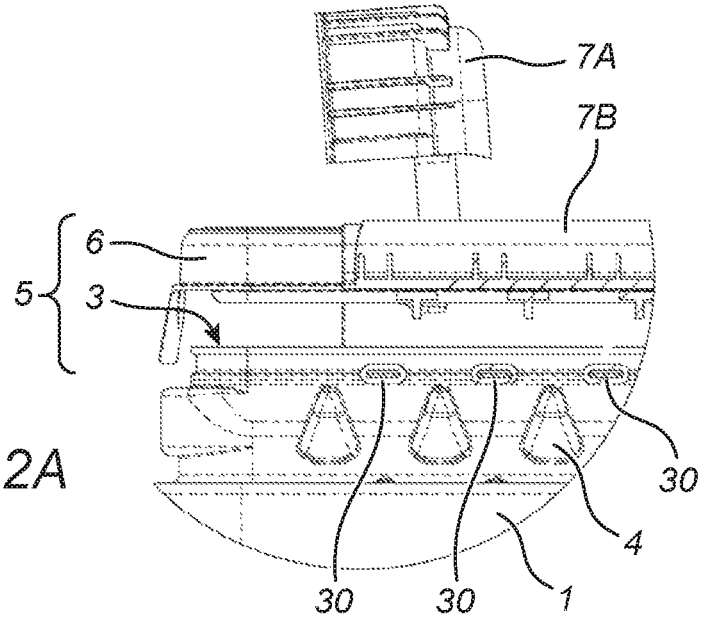
FIGS. 2A-2C detailed sectional views of subsequent stages of closing of the combination of the container and closure unit according FIGS. 1A and 1B.

FIG. 2A shows a detailed sectional view of a first stage of the closing off of a container by the closure unit 5 shown in FIGS. 1A and 1B. The closure unit 5 is brought above an open top surrounding rim 3 of the container 1, while the second tension element part 7A is in a upward turned orientation (full open position). Further, the lower inside wall of the tension element part 7B is provided with cams 30 which function as couplings for cooperation with the counter couplings 4 of the container 1.

Figure 2B:
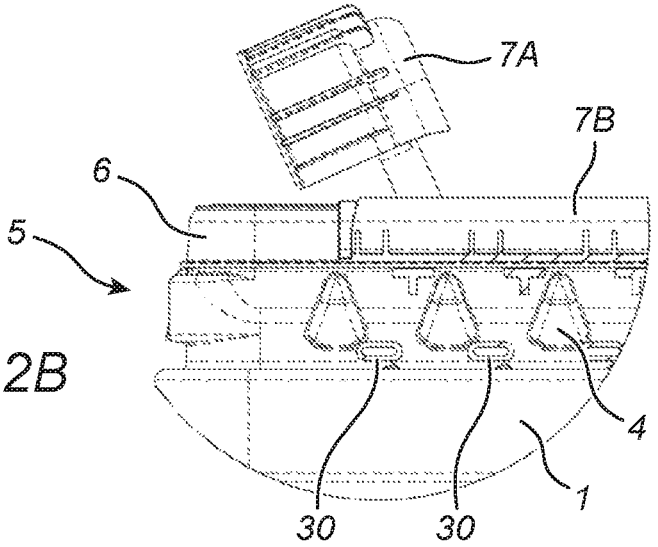

In a subsequent stage shown in FIG. 2B, the closure unit 5 is pressed downwardly by a user onto the container so that the surrounding profile on the underside of the cover plate is fitted onto the rim 3 of the container 1. During the downward movement of the closure unit 5, the cams 30 of tension element 7B are also moved downward, and are aligned with the counter couplings 4 of the container.

By movement of the tension element part 7A towards the left, the tension element part 7B is also drawn to the left because of the hinging connection, while the cover plate is maintained in place onto the rim 3 of the container. Because of this movement of the tension element part 7B, the cams 30 are forced underneath the counter-couplings 4 of the container, and the tension element part 7B is pulled against the cover plate, thus pressing the cover plate more firmly against the rim.

Figure 2C:
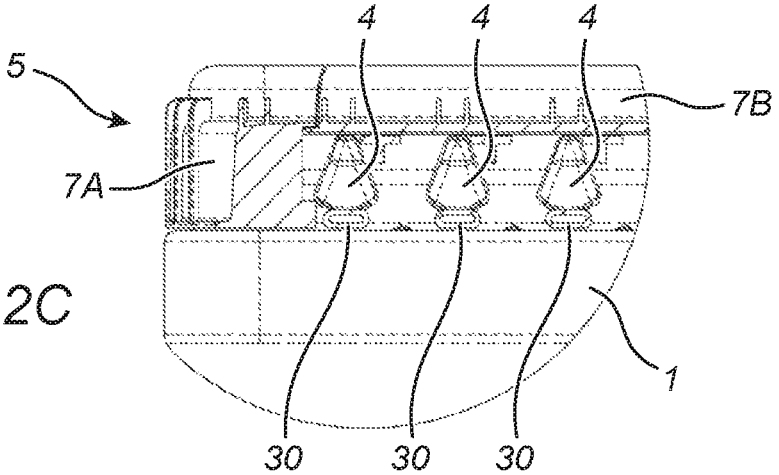

The final stage of closing is shown in FIG. 2C, wherein the cams 30 are in their end position underneath the counter couplings 4, achieving a most firmly pressed cover plate 6 against the rim of the container 1.

Figure 3A:
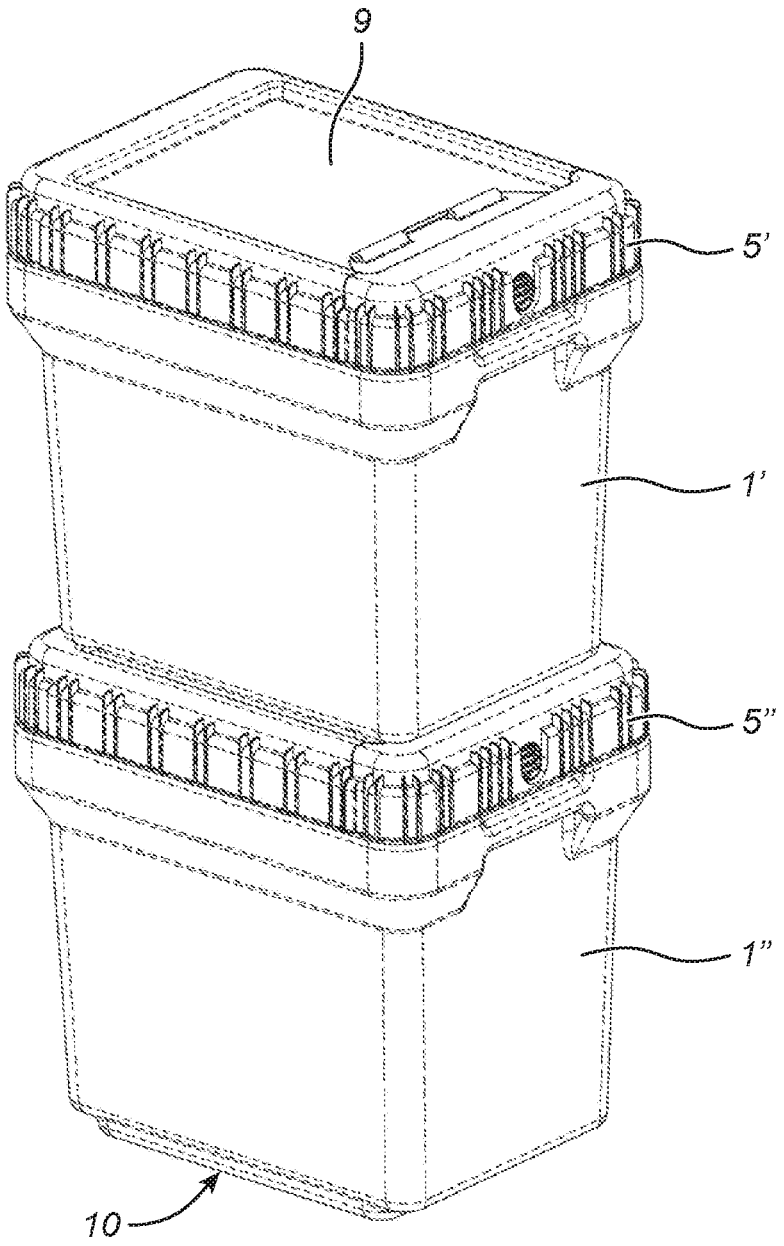
FIGS. 3A and 3B perspective views of two variants of stacked container and closure assemblies according the FIGS. 1A and 1B.

In FIG. 3A two closed combinations of the container 1 and closure unit 5 are depicted in a stacked situation, showing that the top of the closure assemblies 5 is provided with a recess 9 for receiving a bottom 10 of the container 1, thus providing a stack of closed containers 1 more stability.

Figure 3B:
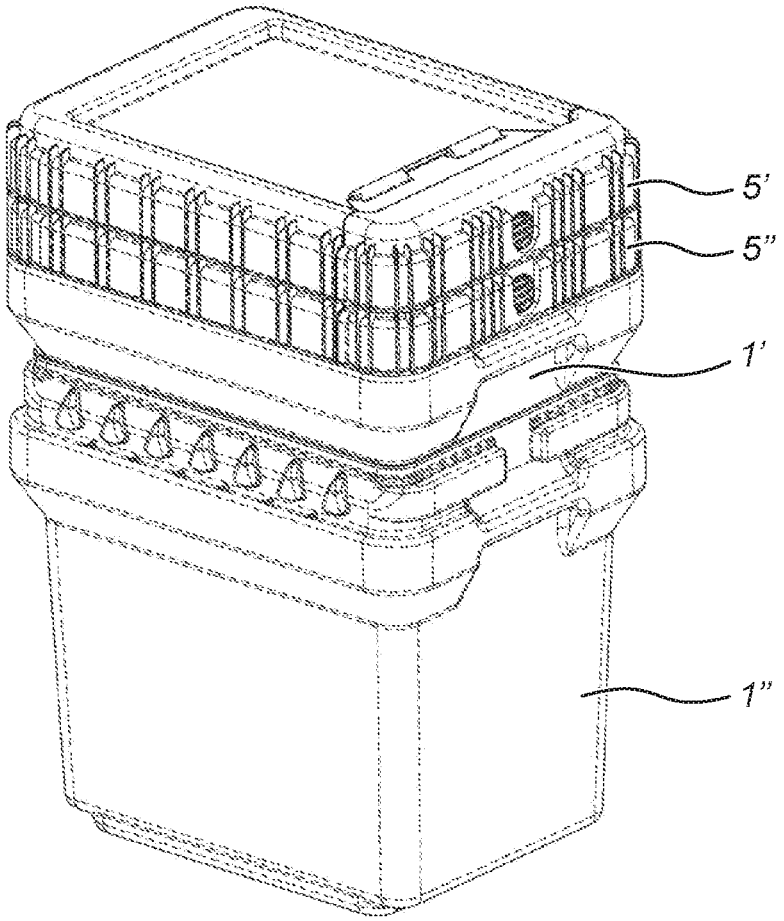

In FIG. 3B an open container 1' is nested with a second closed container 1" and onto the closure unit 5" of the closed container 1" is an individual closure unit 5' stacked. This FIG. 3B shows a further variation of efficient stacking combinations of containers 1, 1', 1" and closure assemblies 5, 5', 5" in various configurations.

Figure 4A:
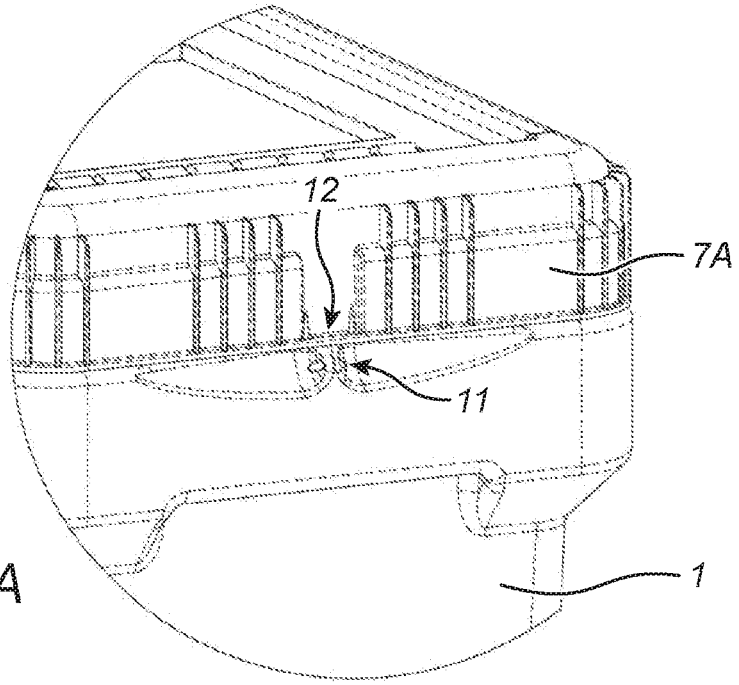
FIGS. 4A and 4B two detailed perspective views of variations of temper proof construction parts incorporated in the closure assemblies according the FIGS. 1A-3B.

FIG. 4A shows a temper proof construction of the container 1 and closure unit 5 combination according the previous figures. In the container a hole 11 is provided and also in the second tension element part 7A a cooperating hole 12 is provided. In the closed orientation of the container 1 and closure unit 5 a—not depicted—sealing may be fed through these holes 11, 12.

Figure 4B:
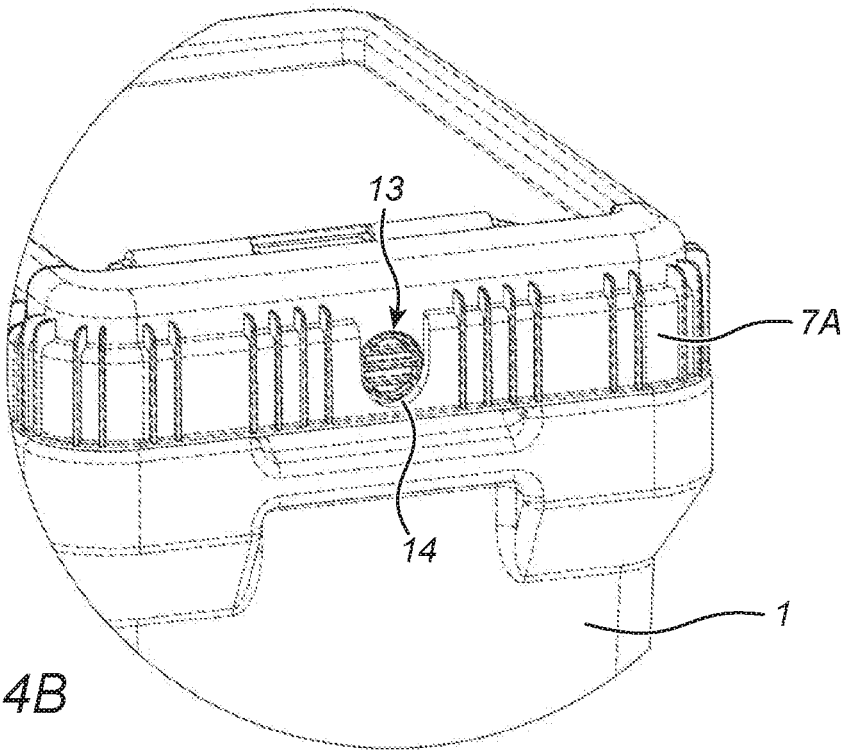

FIG. 4B shows an alternative embodiment of a temper proof construction of the container 1 and closure unit 5 combination according the previous figures. Here a "push button" 13 that is moveable connected to the container 1 and that fits in a matching aperture 14 provided in the second tension element part 7A. The presence of the "push button" 13 in the aperture 14 prevents the uncontrolled upward movement of the second tension element part 7A and thus prevents uncontrolled opening of the container 1.

Figure 5A:
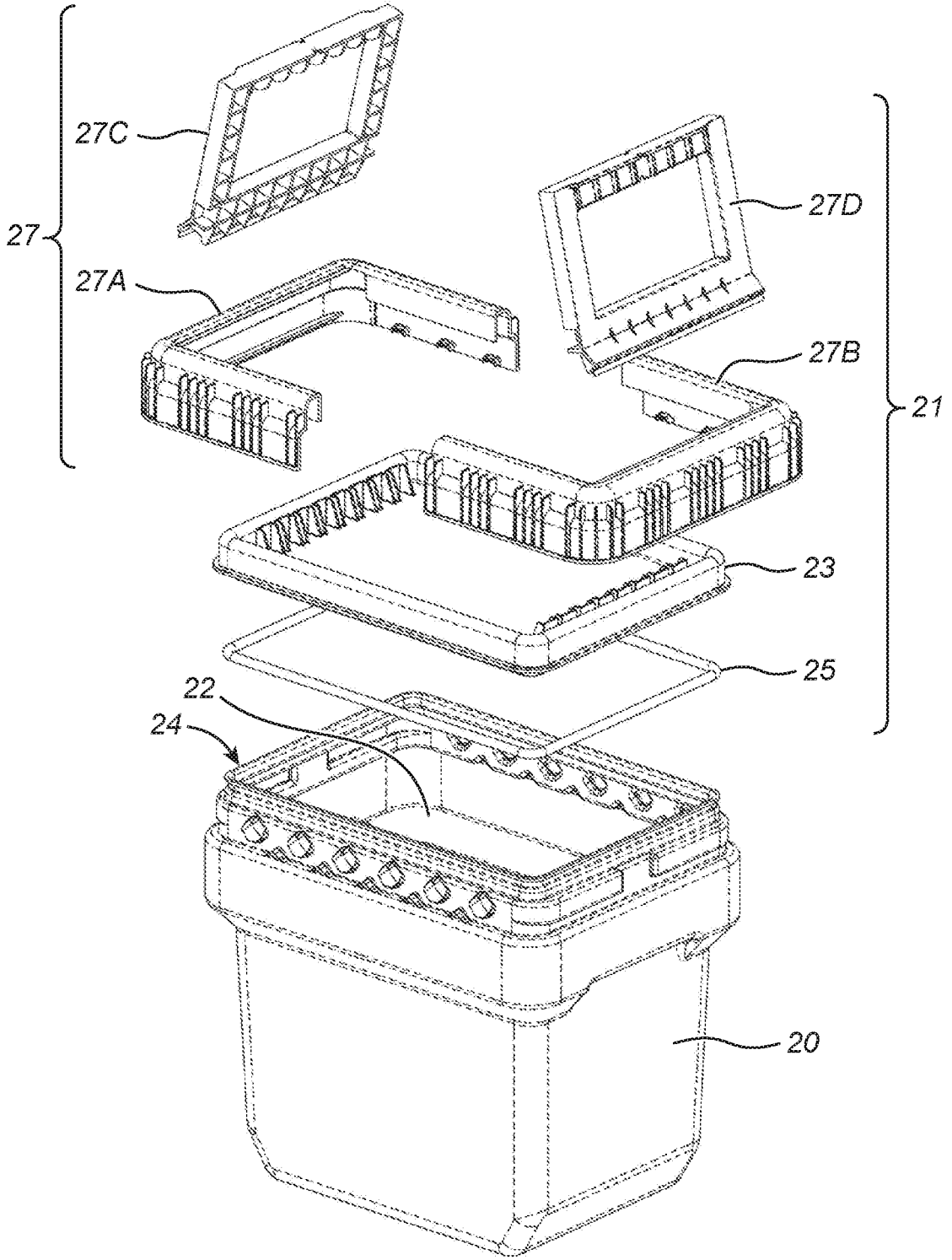
FIG. 5A an exploded view on an alternative embodiment of a combination of a container and closure unit according the invention.
Figure 5B:
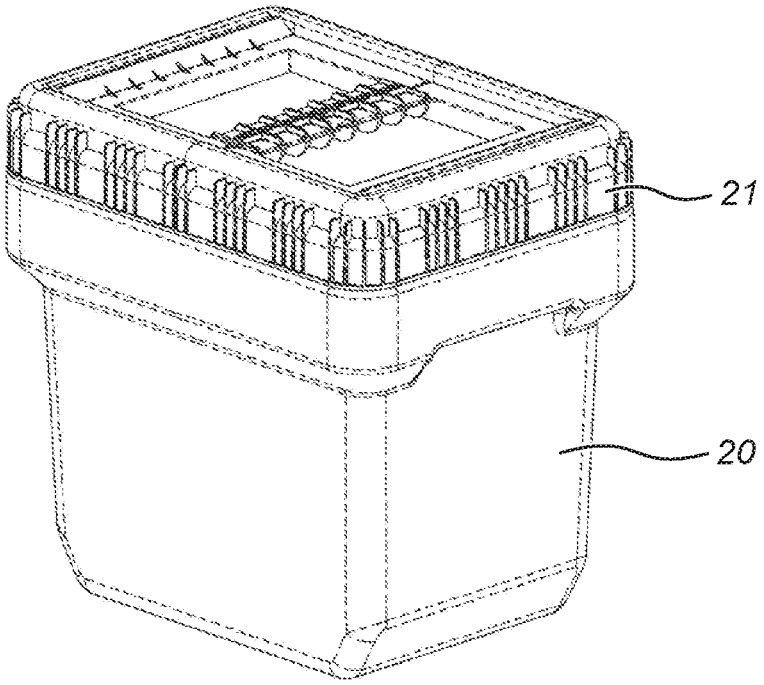
FIG. 5B a perspective view on the combination of the container and closure unit according FIG. 5A in an assembled state and in a closed configuration.

FIG. 5A shows an exploded view on an alternative embodiment of a combination of a container 20 and closure unit 21 according the invention. Also the container 20 has an aperture 22 in the top. Above the container 20, in an exploded view, the closure unit 21 is depicted. The closure unit 21 comprises a substantially flat cover element 23 that fits a rim 24 of the aperture 22 in the container 20. The substantially flat cover element 23 also here has a groove (again not visible in this figure) that fits the rim 24 of the aperture 22 in the container 20. According the embodiment shown in FIGS. 1A and 1B also here in the groove a gasket 25 may be housed. The closure unit 21 also includes a tension element 27 that is composed of four mutual displaceable tension element parts 27A, 27B, 27C, 27D. These four mutual displaceable tension element parts 27A, 27B, 27C, 27D are now rotatable and translatable connectable (instead of only rotatable). For closing the tension element 27 the tension element parts 27A, 27B, 27C, 27D are moved towards each other and for opening the tension element parts 27A, 27B, 27C, 27D are moved away from each other. In FIG. 5B the combination of the container 20 and the closure unit 21 according FIG. 5A is shown in an assembled and closed configuration.

The invention claimed is:

1. A closure unit for a container which closure unit is suitable to be re-used repeatedly for the container, and which closure unit comprises a substantially flat cover element for closing off the aperture in the container, which cover element is provided with a tension element, for creating a pressure force that presses the cover element to a rim that surrounds the aperture of the container in the situation wherein the closure unit is applied onto the container for closing off the aperture;

which tension element is provided with couplings for cooperation with the container in order to create the pressure force, wherein the tension element in a closed position is enclosing at least the perimeter of the substantially flat cover element and is pressing the substantially flat cover element at least at one contact surface while the couplings of the tension element are in cooperating contact with the container;

wherein the tension element is composed of at least two mutually displaceable parts, the mutually displaceable parts being moveable from an open position to the closed position, as well as being conversely movable from the closed position to the open position which allows a user to alternate between the closed position and the open position repeatedly, which open position and closed position achieve respectively an open configuration and a closed configuration of the tension element which allows for a respective opening and closing of the aperture of the container onto which the closure unit is applied and thus allows for the consequent repeated re-use of the closure unit for the container, wherein the closed position of the mutually displaceable parts, in the situation wherein the couplings of the tension element are in cooperating contact with the container, results in at least one contact surface of the tension element being pressed in a direction having at least a pressure force component perpendicular to the flat cover element, wherein the at least two mutually displaceable parts of the tension element are rotatably connected by a hinging connection, which hinging connection abuts an abutment structure provided on the upper side of the cover plate in order for the hinging connection to function as a lever.

2. The closure unit according to claim 1, characterised in that the movement of the mutual displaceable parts of the tension element towards the closed position results in a movement of at least one contact surface of the tension element being displaced in a direction towards the flat cover element.

3. The closure unit according to claim 1, characterised in that the rotatably connected mutually displaceable parts of the tension element in the closed position are lying in a single plane.

4. The closure unit according to claim 1, wherein the tension element is detachably connected to the cover element.

5. The closure unit according to claim 4, characterised in that the cover element is provided with a groove for at least partially receiving the aperture surrounding rim of the container.

6. The closure unit according to claim 5, characterised in that the cover element is provided with a gasket for contacting the aperture surrounding rim of the container.

7. The closure unit according to claim 6, characterised in that the cover element and the tension element are made out of a polymeric material.

8. The closure unit according to claim 7, characterised in that the closure unit has a substantially rectangular or circular shape.

9. A combination of the closure unit according to claim 8 and a container, wherein the container is provided with at least one aperture surrounded by an aperture rim and wherein the closure unit fits the aperture rim.

10. The combination of a container and closure unit according to claim 9, characterised in that the container is an substantially 3d rectangular shaped box having a substantially rectangular open top or the container is an substantially drum shaped having a substantially circular open top.

11. The combination of a container and closure unit according to claim 10, characterised in that the container is provided with cooperating counter-couplings that cooperate with the couplings of the closure unit in such a way that in the closed configuration of the tension element an interlocking of the couplings and counter-couplings is achieved which creates a pressure force that presses the cover element onto the container.

12. A method for closing a container, comprising the method steps of:

A) providing an open topped container;

B) placing a closure unit according to claim 1 on the container with the tension element in an open configuration, so that a cover element contacts an aperture surrounding rim the container, whereby couplings of the closure unit are aligned with counter couplings on the container for mutual interlocking;

C) moving mutually displaceable parts of the tension element of the closure unit from an open position to a closed position whereby an interlocking of the couplings and counter-couplings is accomplished such that a pressure force is exerted by the tension element onto the cover element in the direction towards the container.

13. A method for opening a container closed off by a closure unit according to claim 1, wherein the container is closed off by a pressure force that is exerted by the tension element onto the cover element in the direction towards the container by virtue of the mutual interlocking of couplings and counter-couplings, comprising the method steps of:

X) moving the mutually displaceable parts of the tension element of the closure unit from the closed position to the opened position whereby the mutual interlocking of the couplings and counter-couplings is unlocked; and Y) removing the closure unit from the container such that the aperture of the container is rendered free.

* * * * *